US005502949A

United States Patent [19]

Main et al.

[11] Patent Number: 5,502,949

[45] Date of Patent: Apr. 2, 1996

[54] FRUIT BIN FILLER

[76] Inventors: Tim B. Main; Scott C. Main, both of 1030 Gibson Rd., Selah, Wash. 98942

[21] Appl. No.: 193,252

[22] Filed: Feb. 8, 1994

[51] Int. Cl.[6] ..... B65B 35/30

[52] U.S. Cl. ..... 53/448; 53/535; 53/537; 53/245; 53/247

[58] Field of Search ..... 53/444, 443, 447, 53/64, 448, 475, 495, 535, 537, 245, 247, 148, 540, 236, 259, 260

[56] References Cited

U.S. PATENT DOCUMENTS

| | | | |
|---|---|---|---|
| 2,896,384 | 7/1959 | Carlsen et al. | 53/59 |
| 3,229,444 | 1/1966 | Rouse | 53/245 |
| 3,269,083 | 8/1966 | Marano | 53/64 |
| 3,420,038 | 1/1969 | Crabb | 53/248 |
| 3,932,982 | 1/1976 | Klapp | 53/259 |
| 4,062,168 | 12/1977 | Watts et al. | 53/64 |
| 4,081,096 | 3/1978 | Kupcikevicius | 53/391 |
| 4,194,343 | 3/1980 | Myers et al. | 53/493 |
| 4,329,831 | 5/1982 | Warkentin et al. | 53/537 |
| 4,464,880 | 8/1984 | Peters et al. | 53/259 |
| 4,600,065 | 7/1986 | Morris | 177/123 |
| 4,608,808 | 9/1986 | Ryan et al. | 53/436 |
| 4,875,327 | 10/1989 | Wilde | 53/475 |
| 4,965,982 | 10/1990 | Jesperson et al. | 53/248 |
| 5,159,796 | 11/1992 | Tas | 53/245 |

FOREIGN PATENT DOCUMENTS

| | | | |
|---|---|---|---|
| 1243086 | 6/1967 | Germany | 53/259 |
| 600034 | 3/1978 | U.S.S.R. | 53/502 |

*Primary Examiner*—Lowell A. Larson
*Assistant Examiner*—Gene L. Kim
*Attorney, Agent, or Firm*—Stratton Ballew

[57] ABSTRACT

A dry fruit bin filler for rapidly filling fruit bins, including a continuous fruit infeed belt and a fruit distribution belt mounted below the infeed belt which reciprocates under the infeed belt to receive and distribute the fruit layer-by-layer in the bin. The distribution belt is coupled to a sensor which controls intermittent activity of the belt based on the position of a discharge end of the belt relative to the bottom of the bin. The distribution belt is activated when the discharge end reaches the bottom of the bin, and lays down a layer of fruit as the belt retracts from the bin. To facilitate the layer-by-layer loading, the bin is held in a rotatable bin holder. The bin holder incrementally rotates during loading, so that the bin is lowered incrementally by a distance corresponding to a height of the layer of fruit.

6 Claims, 3 Drawing Sheets

FRUIT BIN FILLER

BACKGROUND OF THE INVENTION

The tree fruit industry harvests and stores its product in wooden bins which are usually 48"×48"×30" deep. There are two basic methods of processing and packing these tree fruits after harvest. One is "pre-size" and the other is "commit to pack".

Pre-size

Fruit is emptied from the bin, hand graded and electronically graded, and is then put in large water canals called flumes. After the proper amount of graded fruit is in the flume, it is released and goes to a water bin filler. Water is used as the cushion medium and the bruise level, even though high at times, has been accepted by pre-size operators simply because no alternative has surfaced.

The down side of this process is that only the largest packers can financially afford a "pre-size" plant. The capital investment is from $2.5 to $3.5 million.

Commit to Pack

Fruit is emptied from the bin, run through washing, waxing and grading machines, and is then packed into boxes containing one bushel. In this process, every acceptable piece of fruit is put into a finished or packed box. The packed boxes then go into storage or inventory. Most often, sales are only for a few sizes or grades. The packing house, therefore, incurs the expense of a large packed box inventory.

The ideal scenario would be to pack what has been sold, and re-bin the rest for bulk storage by size and grade, and then pack the product as it is sold.

By recognizing the large demand for a "gentle fruit-handling" high speed dry bin filler, the design disclosed herein has evolved.

The typical dry bin filler in the industry has the bin at floor level, and has to have the fruit lowered into it. These heights are up to four feet. These types of filers are not capable of handling the fruit without bruising the product.

The bin will rotate and the fruit is expected to roll to the periphery of the bin. Too much fruit movement results in bruising, which renders the fruit unsaleable.

The invention disclosed herein brings the bin to the fruit, and lays the fruit into the bin a complete layer at a time. This method insures positive control of the fruit, which enables this design to fill a bin with product that has not been bruised. This design also allows filling of the bin at a high rate of speed.

BRIEF SUMMARY OF THE INVENTION

The invention comprises a steel frame which supports an infeed belt which receives the graded fruit, and a distribution belt which places the fruit into the bin in layers. The infeed belt is always operating. The distribution belt reciprocates below the infeed belt. Each belt is approximately the width of the interior of the bin to be filled.

A bin is placed in a framework at the discharge end of the filler. The framework rotates the bin around a point which is at approximately the upper edge of the bin nearest the filler. Initially the bin is almost vertical with the open side facing the filler. As the bin receives a layer of fruit, it rotates downward one layer in height.

As the distribution belt moves into the bin, and receives fruit from the infeed belt, the distribution belt does not feed. When the distribution belt nears the bottom or side of the bin, the sensor activates the distribution belt which then begins to feed a layer of fruit into the bin at the same time that the distribution belt retracts.

DETAILED DESCRIPTION OF THE INVENTION

Figure 1:
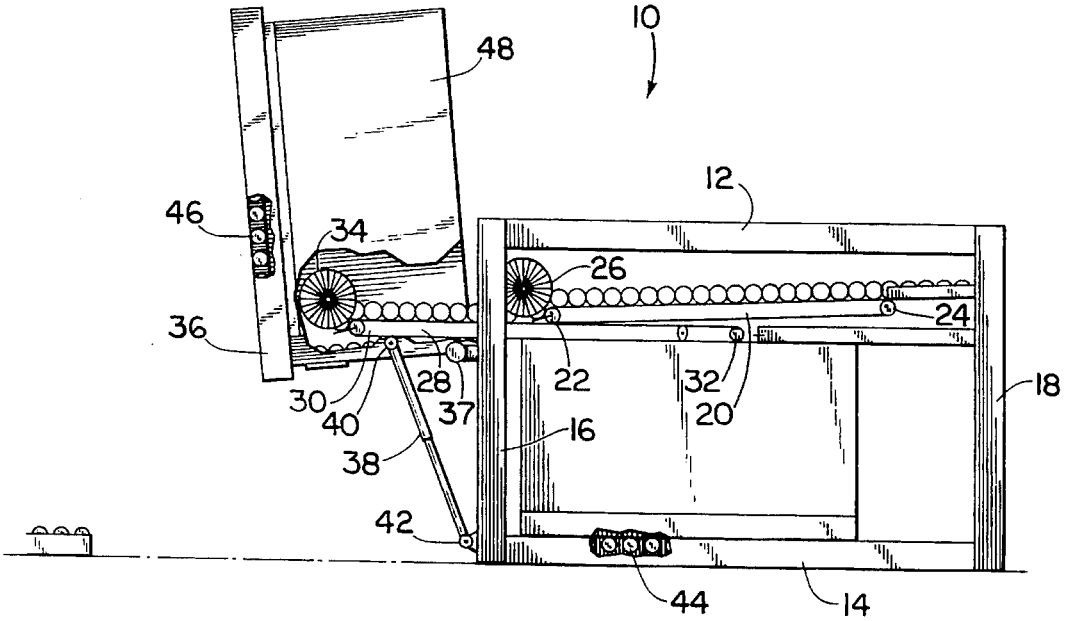
FIG. 1 illustrates the dry fruit bin loader at the start of a loading cycle.
Figure 2:
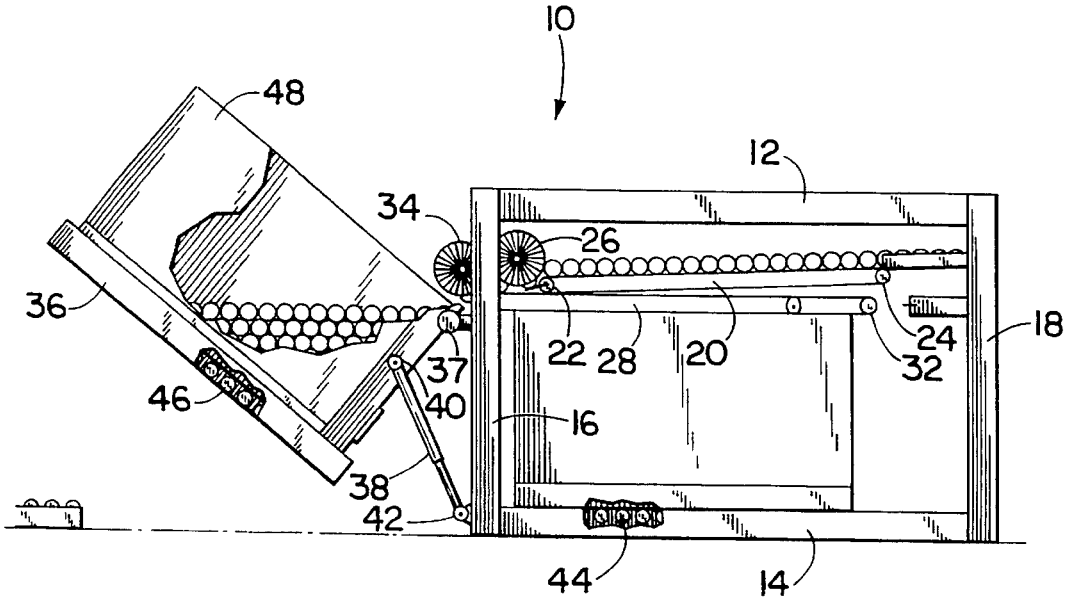
FIG. 2 illustrates the dry fruit bin loader part way through a loading cycle.
Figure 3:
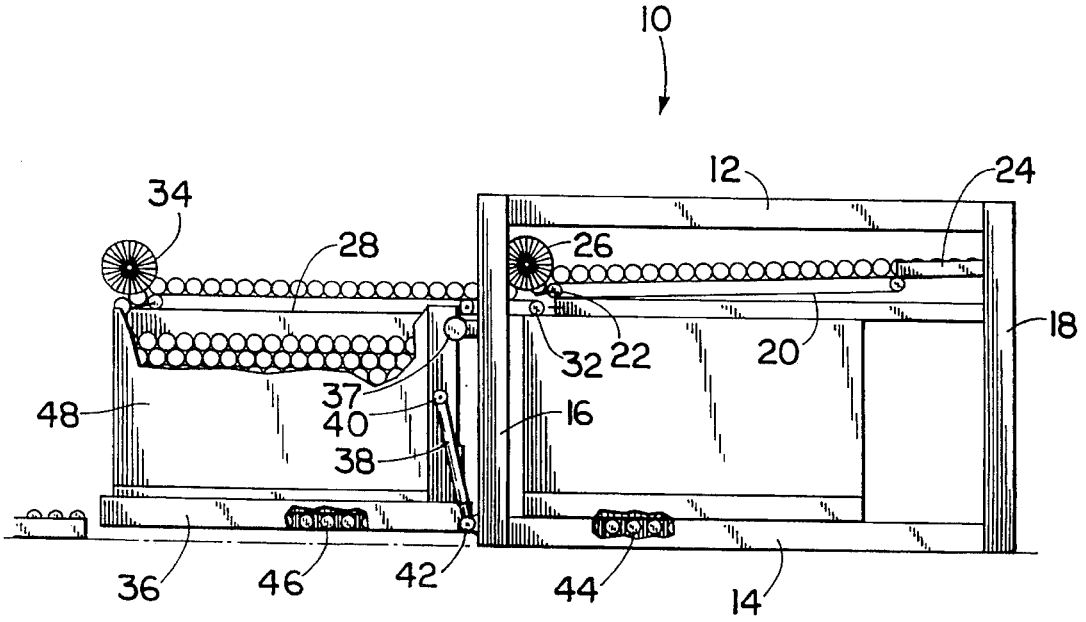
FIG. 3 illustrates the dry fruit bin loader near the completion of a loading cycle.

The dry bin fruit loader is illustrated generally as 10. The loader has a framework comprising upper horizontal bar 12, lower horizontal bar 14, vertical bar 16 and vertical bar 18. The frames on either side of the loader 10 are identical. Crossbars (not shown) space the two frames apart. The infeed belt 20 is supported by sprockets 22 and 24. A rotatable brush 26 is mounted at the inner end of infeed belt 20 to slow the vertical descent of the fruit. Distribution belt 28 is supported by sprockets 30 and 32. A rotatable brush 34 slows the vertical descent of fruit from the distribution belt.

A rotating bin holder 36 is attached to the loader framework. A pivot 37 on the rotating frame is supported by the loader framework on vertical bar 16. A hydraulic piston and rod 38 is attached to vertical bar 16 near its bottom and to the rotating bin holder below the pivot 37. Each end of hydraulic piston and rod 38 is secured at either end by rotatable attachments 40 and 42.

The bottom of the loader framework is fitted with rollers 44 to assist in easy movement of the fruit bin. The bottom of the rotating frame is provided with rollers 46 to assist in easy movement of the fruit bin.

FIG. 1 illustrates the beginning of a bin loading cycle. While infeed belt 20 is operating distribution belt 28 begins to extend into the bin 48. Distribution belt 28 is not advancing relative to the sprockets 30, 32 while it extends into the bin. A sensor (not shown) located near brush 34 senses when to begin unloading distribution belt 28. At that point distribution belt 28 begins movement of the belt, and simultaneously retracts, while loading fruit into the bin 48. When a layer of fruit has been deposited into the bin 48, distribution belt 28 stops its loading movement, the bin 48 rotates enough for a new layer of fruit to be deposited, and distribution belt 28 extends again into the bin 48 while receiving fruit from the infeed belt. As the distribution belt 28 nears the bottom of the bin 48, the sensor activates distribution belt 28 which then begins movement and retraction. This method of loading continues until the bin 48 is fully loaded with fruit. At that point, the bin 48 is horizontaL, and the loading process is stopped. The loaded bin 48 is rolled away, and a new bin is placed into the rotating bin holder.

A suitable belt for the infeed belt and the distribution belt would be Uni-Light 0 (10% open) manufactured of polypropylene.

There has been disclosed above an apparatus for high speed non-bruising dry bin loading. A distribution belt continuously reciprocates into and out of the bin, receiving fruit from the infeed belt while moving into the bin, and then the distribution belt begins advancing and deposits the fruit in layers into the bin.

While this invention is susceptible of embodiment in different forms, the drawings and the specification illustrate the preferred embodiment of the invention, with the understanding that the present disclosure is to be considered an exemplification of the principles of the invention, and the disclosure is not intended to limit the invention to the particular embodiment described.

I claim:

1. A dry fruit bin filler for rapidly filling standard-sized, dry fruit bins with fruit, while minimizing bruising damage to the fruit, comprising:

a frame supporting a fruit infeed belt, the infeed belt having a belt width approximately the same as a standard width of the fruit bin;

a fruit distribution belt supported by the frame below the infeed belt, the distribution belt positioned and dimensioned to receive fruit from the infeed belt;

bi-directional distribution belt reciprocating means for reciprocating the distribution belt relative to the infeed belt, the reciprocating means functional to advance a discharge end of the distribution belt toward a bottom of the bin during a distribution belt loading operation, and to retract the discharge end of the distribution belt away from the bottom of the bin during a distribution belt discharge operation;

infeed belt driving means for continuously driving the infeed belt in a feeding direction while the discharge end of the distribution belt is advancing toward the bottom of the bin and for discontinuing driving the infeed belt while the discharge end retracts away from the bottom of the bin, so that the distribution belt is loaded with fruit from the infeed belt while the distribution belt reciprocates into the bin;

sensor means for sensing a position of the distribution belt discharge end relative to the bottom of the bin; and distribution belt control means operatively coupled to the sensor means for driving the distribution belt in a discharging direction while the discharge end retracts away from the bottom of the bin, and for discontinuing driving movement of the distribution belt while the discharge end advances toward the bottom of the bin.

2. A dry fruit bin filler according to claim 1, including rotating means for rotating a fruit bin holder pivotally attached to the frame and adapted to receive the bin within a framework of the holder, the rotating means adapted to rotate the holder and bin about a point juxtaposed to an upper edge of the bin nearest the filler.

3. A dry fruit bin filler according to claim 2, wherein the rotating means is adapted to rotate the bin through approximately a 90 degree range of angular positions relative to a longitudinal axis of the distribution belt.

4. A dry fruit bin filler according to claim 3, wherein the holder is rotatable in a stepwise manner to incrementally lower the fruit bin relative to the distribution belt a distance corresponding approximately to a height of a layer of fruit to be loaded.

5. A method for rapidly filling standard-sized, dry fruit bins with fruit, while minimizing bruising damage to the fruit, comprising the steps of:

bi-directionally reciprocating a fruit distribution belt relative to a fruit infeed belt to advance a discharge end of the distribution belt toward a bottom of the bin during a distribution belt loading operation, and to retract the discharge end of the distribution belt away from the bottom of the bin during a distribution belt discharge operation;

continuously driving the infeed belt in a feeding direction while the discharge end of the distribution belt is advancing toward the bottom of the bin and for discontinuing driving the infeed belt while the discharge end retracts away from the bottom of the bin, so that the distribution belt is loaded with fruit from the infeed belt while the distribution belt reciprocates into the bin driving the distribution belt in a discharging direction when the discharge end retracts away from the bottom of the bin, and discontinuing driving of the distribution belt while the discharge end advances toward the bottom of the bin.

6. A method according to claim 5, including the steps of sensing a position of the distribution belt discharge end relative to the bottom of the bin to provide a sensed position of the discharge end, and, depending on changes in the sensed position of the discharged end, driving the distribution belt in a discharging direction when the discharge end retracts away from the bottom of the bin, and discontinuing driving of the distribution belt when the discharge end advances toward the bottom of the bin.

* * * * *